US006796687B2

(12) United States Patent
Hudak et al.

(10) Patent No.: US 6,796,687 B2
(45) Date of Patent: Sep. 28, 2004

(54) LUMINAIRE GLOBE HAVING LOW GLARE BANDLESS SEAM

(75) Inventors: Joseph C. Hudak, Newark, OH (US); Fred C. Schlichter, Newark, OH (US); Scott L. Posey, Newark, OH (US); Gregory J. Subisak, Gahanna, OH (US)

(73) Assignee: Acuity Brands, Inc., Atlanta, GA (US)

( * ) Notice: Subject to any disclaimer, the term of this patent is extended or adjusted under 35 U.S.C. 154(b) by 54 days.

(21) Appl. No.: 10/280,280

(22) Filed: Oct. 25, 2002

(65) Prior Publication Data

US 2004/0080946 A1 Apr. 29, 2004

(51) Int. Cl.[7] ..... F21V 13/04
(52) U.S. Cl. ..... 362/308; 362/329; 362/267
(58) Field of Search ..... 362/308, 329, 362/267, 158, 299, 327, 339, 309, 363, 334, 333, 340

(56) References Cited

U.S. PATENT DOCUMENTS 2,148,314 A * 2/1939 Wright ..... 362/308
2,148,315 A * 2/1939 Wright ..... 362/308
4,719,548 A * 1/1988 Orosz ..... 362/309

* cited by examiner

*Primary Examiner*—Sandra O'Shea
*Assistant Examiner*—Bao Q Truong
(74) *Attorney, Agent, or Firm*—Kenneth E. Darnell

(57) ABSTRACT

A bandless seam between reflector and refractor sections of a luminaire globe formed of light-transmissive material and configured to improve optical performance as well as facilitate effective mounting of the reflector and refractor sections together, the invention finds particular utility with suspended luminaires ordinarily requiring a metal band or the like to join said sections into a luminaire globe. Opposing peripheral edge surfaces of the reflector and refractor sections are shaped according to the invention not only to cause even flow of adhesive between said surfaces to adhere said sections to each other but also to reduce brightness at the resulting seam between the sections, thereby improving luminaire appearance and reducing seam brightness and optical glint.

46 Claims, 10 Drawing Sheets

LUMINAIRE GLOBE HAVING LOW GLARE BANDLESS SEAM

BACKGROUND OF THE INVENTION

1. Field of the Invention

The invention relates generally to luminaires having reflector and refractor sections preferably formed of light-transmissive material and mated together to form a globe within which a light source is disposed, the invention particularly relating to a bandless seam between said sections and having improved appearance and optical characteristics.

2. Description of the Prior Art

Luminaires intended for both indoor and outdoor illumination have long been known in the art to include combination reflector/refractor light-transmissive "globes" utilizable with a variety of lamping configurations to provide particular light distribution characteristics for a given application. Such reflector/refractor combinations have typically been formed of materials such as glass and plastic materials such as acrylics, etc., and often employ prisms and similar light-altering structures formed on either interior or exterior surfaces, or both, of such prior reflector/refractor combinations. Light is directed in these prior combinations from an associated lamp in a manner providing a desired level of lighting within a space that is to be illuminated. In applications thus referred to, at least the refractor section of the combination is formed of a light-transmissive material such as glass with the reflector section often being formed also of glass or a light-transmissive acrylic material or the like. Luminaire globes of this description are typically either pole-mounted, usually for outdoor applications, or "suspended" for either indoor or outdoor applications. When a luminaire globe of the kind referred to herein is "pole-mounted", support for the globe is typically provided from a location beneath the globe, it not therefore being as necessary to provide a positive attachment between the reflector section and the refractor section since the seam or joint therebetween is not required to support the weight of the refractor section. In suspended applications, it is usually necessary to positively attach the refractor section to the surmounting reflector section such as through the use of a band or other mechanical support. It should be noted, however, that globes used in pole-mounted applications often provide a band at a seam between reflector and refractor sections for increased surety of connection therebetween and/or for the sake of appearance. For example, Ewing, in U.S. Pat. No. Des. 441,115, shows a luminaire globe intended to be supported by a pole from beneath said globe. Ewing also provides a band at the seam between reflector and refractor sections as an element of the appearance of the luminaire as well as for providing an increased degree of attachment therebeween. Other patents disclosing luminaire globes formed of light-transmissive material and being mounted such as at the upper ends of poles or similar stanchions are disclosed by Sitzema et al, in U.S. Pat. No. 5,743,634, and by Orosz, in U.S. Pat. No. 4,719,548, the disclosures of these patents being incorporated hereinto by reference. Sitzema et al particularly disclose a reflector/refractor combination formable of either glass or acrylic materials and wherein a pole or the like supports the refractor for mounting of the reflector thereto, there being no need therefore to support the weight of the refractor with a band formed about a seam or joint between the reflector and the refractor. However, Sitzema et al disclose the use of an adhesive to adhere the reflector to the refractor. In Sitzema et al, adhesive is not employed to attach the refractor directly to the reflector such that an adhesive joint is the sole mechanism for preventing detachment between the reflector and the refractor. Orosz attaches a refractor to a surmounting reflector through the use of an adhesive and screws even though the Orosz luminaire is mounted by a pole.

Arumugasaamy, in U.S. Pat. No. 6,336,734 and also in U.S. Pat. No. Des. 4,040,341, discloses a glass reflector/refractor combination in a suspended luminaire and having a band employed at a seam between the reflector and the refractor for supporting the weight of the refractor. Arumugasammy illustrates the manner in which the use of a band can be incorporated into the appearance of a suspended luminaire in an effective manner. Other United States design patents having similar disclosures are issued to Ewing et al, as U.S. Pat. No. Des. 400,273; Gruber et al as U.S. Pat. No. Des. 350,622; and to Hughes et al as U.S. Pat. No. Des. 321,408. In U.S. Pat. No. 5,174,648, Clary et al disclose a suspended luminaire having a glass or acrylic globe with a band formed about the seam therebetween for supporting at least in part the weight of a refractor portion of the luminaire. Van Steenhoven, in U.S. Pat. No. 3,950,639, mounts a refractor to a reflector by means of a metal ring formed about a seam between the reflector and refractor. Harling, in U.S. Pat. No. 3,329,812, mounts a glass refractor to a metal reflector. Fouke, in U.S. Pat. No. 6,027,231 provides a flange at a seam between a glass reflector/refractor combination, the disclosure of this patent being incorporated hereinto by reference. Similar disclosure is also provided by Fouke in U.S. Pat. No. 4,858,091, the disclosure of which is incorporated hereinto by reference. Luminaire globes comprising reflector/refractor combinations are disclosed by Blondel et al, in U.S. Pat. No. 563,836 and by Franck, in U.S. Pat. Nos. 2,818,500 and 2,887,568, the disclosures of these patents being incorporated hereinto by reference.

As can be appreciated from a review of the patents noted above, it has been common in the art to employ a band or similar structure about a seam between a reflector section and a refractor section of a luminaire globe in order to positively attach the refractor to the reflector especially in suspended situations and, as can be seen from a review of certain of the patents noted above, even in pole-mounted applications. The necessity for the use of a band or similar structure has been ameliorated by the creativity of the designers of such luminaire globes through the agency of causing the bands or similar structure to be decorative. However, the use of a band or the like invariably causes a reduction in lighting performance since light is lost through reflection off internal surfaces of such a band and such bands prevent uninterrupted illumination through the entirety of the refractor section of such a globe. Even in luminaire globes not employing bands, a seam or joint between reflector and refractor sections typically causes glare or optical "glint" due to the fact that light passing through the seam produces a line or "band" of bright light that differs from the quality of light passing through the reflector section and the refractor section, said reflector and refractor sections often being provided at considerable expense with prismatic structures intended to produce a pleasing quality of light emanating from the luminaire globe.

In applications where a "clean" appearance is desired, that is, a "bandless" appearance is necessary in order to provide decorative function inter alia, prior approaches to solution of the above-noted deficiencies in the art have not yielded luminaire globe function of a kind acceptable to particular applications when considering appearance and evenness of illumination. An advance in the art would therefore be realized through an ability to attach a refractor to a reflector, particularly for a suspended luminaire, without the requirement for a band disposed about a seam between a reflector and refractor and wherein the seam therebetween is not subject to a high degree of optical glint and/or glare. The present invention therefore intends solution to the deficiencies noted above by providing a seam or joint between a reflector section and a refractor section of a luminaire globe whereby adhesive is evenly applied to opposed mating peripheral edges thereof to reduce brightness at the seam and to provide at least some degree of attachment function at the joint therebetween. Luminaire globes configured according to the invention therefore exhibit a desired physical appearance and produce a desirable quality of illumination.

SUMMARY OF THE INVENTION

The invention in several aspects relates to structure and methodology involving a seam or joint between reflector and refractor sections of a luminaire globe such as a globe formed of glass, acrylic or other light-transmissive material. Luminaire globes improved according to the teachings of the invention typically have prismatic or similar light-directing structures on either the reflector section or the refractor section, or both. Luminaire globes that are component parts of suspended luminaires, in particular, must be provided with a mechanism whereby a relatively heavy refractor section is caused to be mounted or attached to a surmounting reflector section, the seam or joint therebetween optically differing from remaining portions of the luminaire globe. Accordingly, the seam visibly differs from remaining portions of the globe and is typically a source of glare or optical glint due to the seam appearing as a bright annular "line" extending about the globe.

The invention in its several aspects provides shaped surfaces on mating annular peripheral edges of the reflector section and of the refractor section, these shaped surfaces particularly acting to cause an even flow of an adhesive applied thereto on joining of the reflector and the refractor sections together. This even flow of adhesive causes the seam between said sections to be optically more acceptable due to the existence of adhesive in a uniform disposition essentially throughout the seam, light passing through the seam being caused to be more efficiently passed therethrough and with improved appearance. Further, an even and complete flow of the adhesive over mating surfaces of the reflector and of the refractor permits the formation of a joint of greater strength to the degree that relatively small luminaire globes, even when used in a suspended luminaire, can be mounted together solely through the use of adhesive.

In essential form, the invention minimizes flanges typically employed between reflector and refractor sections of a luminaire globe to the point of permitting a continuous curvature to exist between the reflector and refractor section, that is, to essentially eliminate the appearance of an external flange altogether. The shaped surfaces of the mating peripheral edges of the reflector and refractor sections act to provide a necessary degree of alignment between the reflector and refractor sections as well as to cause uniform flow of adhesive within the joint between said sections. An appropriate sizing and shaping of certain wall surfaces of the structure defining the present seam also functions to reduce glare by directing light passing through the seam above horizontal so as not to be visible from normal locations within an environmental space in which a luminaire employing the present globes are disposed.

Accordingly, it is a primary object of the present invention to provide a seam for a luminaire globe formed of a reflector section and a refractor section wherein peripheral opposed edges of said sections are contoured in order to cause even flow of adhesive therebetween when joined together and to further reduce optical glint and glare due to shaping of at least portions of said section edges defining the seam.

It is another object of the present invention to provide a seam between reflector and refractor sections of a luminaire globe formed of a light transmissive material such as glass, acrylic or the like, and wherein the appearance of the seam is minimized.

It is a further object of the invention to provide a luminaire globe formed of reflector and refractor sections wherein the sections are provided with contoured peripheral edges joinable together to attach said sections without the need for a structural band disposed over the seam for attaching the refractor section to the reflector section.

Further objects and advantages of the invention will become more readily apparent in light of the following detailed description of the preferred embodiments.

DESCRIPTION OF THE PREFERRED EMBODIMENTS

Reference is hereby made to U.S. patent application Ser. No. 10/280,279, filed of even date and entitled "Prismatic Structures Having Shaped Surfaces" and assigned to the present assignee, the disclosure of this patent application being incorporated hereinto by reference. Reference is further made to U.S. patent application Ser. No. 10/280,281, filed of even date and entitled "Reflector/Refractor Light Control Luminaire" and assigned to the present assignee, the disclosure of this patent application being incorporated hereinto by reference.

Figure 1:
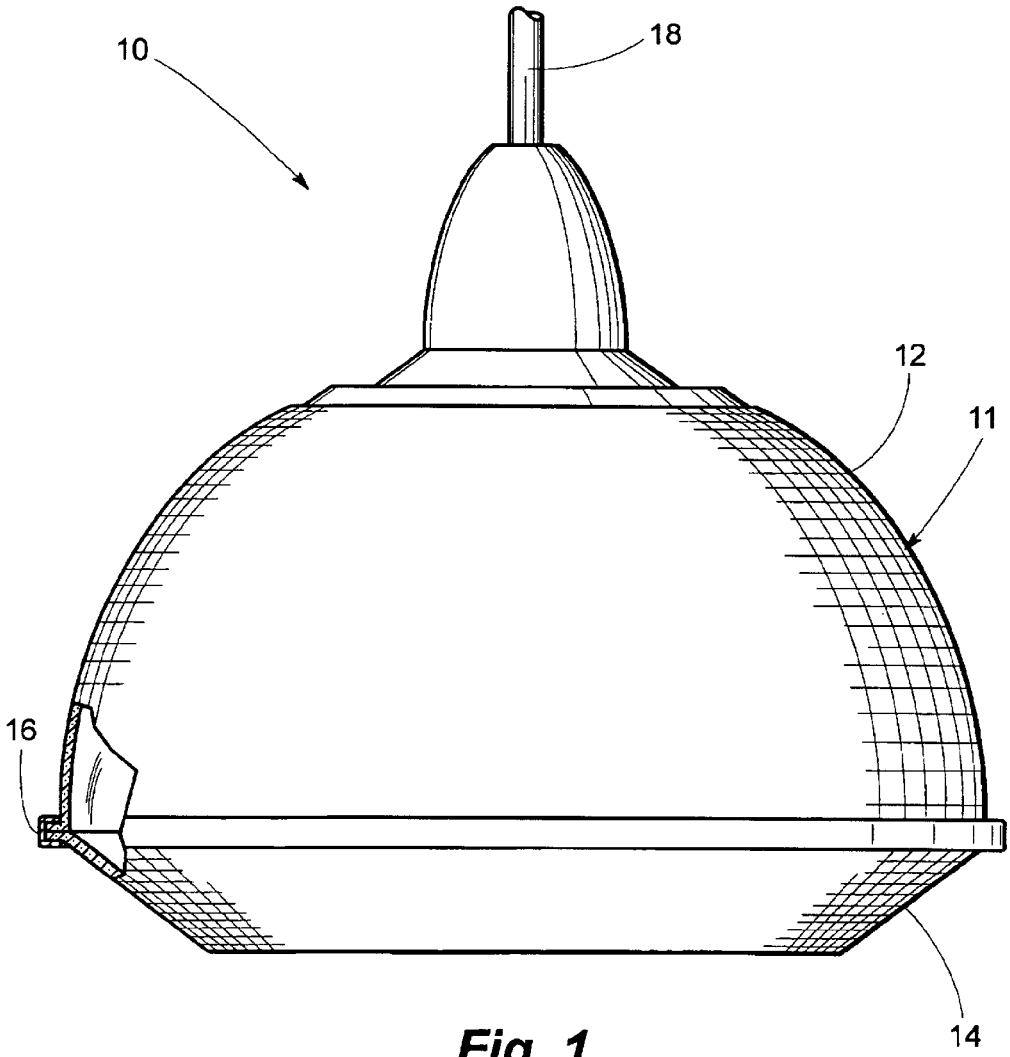
Fig. 1 Prior Art
FIG. 1 is a side elevational view of a luminaire globe of the prior art forming a component part of a suspended luminaire and wherein a structural band is disposed about a seam between reflector and refractor portions of the globe for purposes of attaching said portions together.
Figure 10:
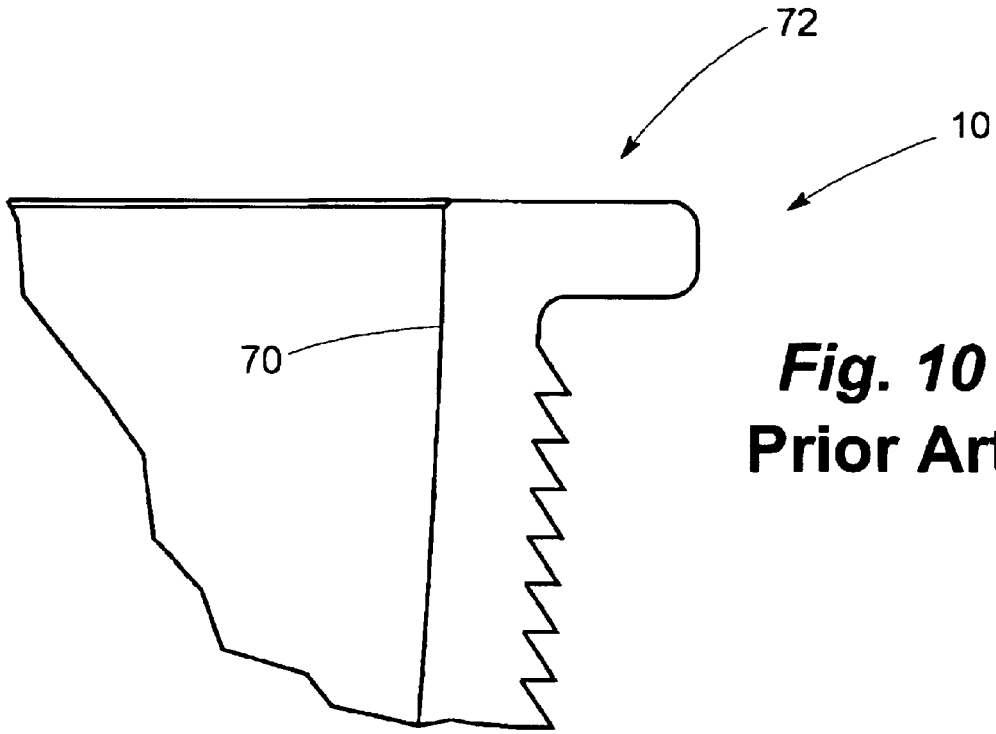
Fig. 10 Prior Art
FIG. 10 is a schematic illustrating a prior art flange arrangement configured conventionally for joining reflector and refractor portions of a prior art luminaire globe together according to the teachings of the prior art.
Figure 11:
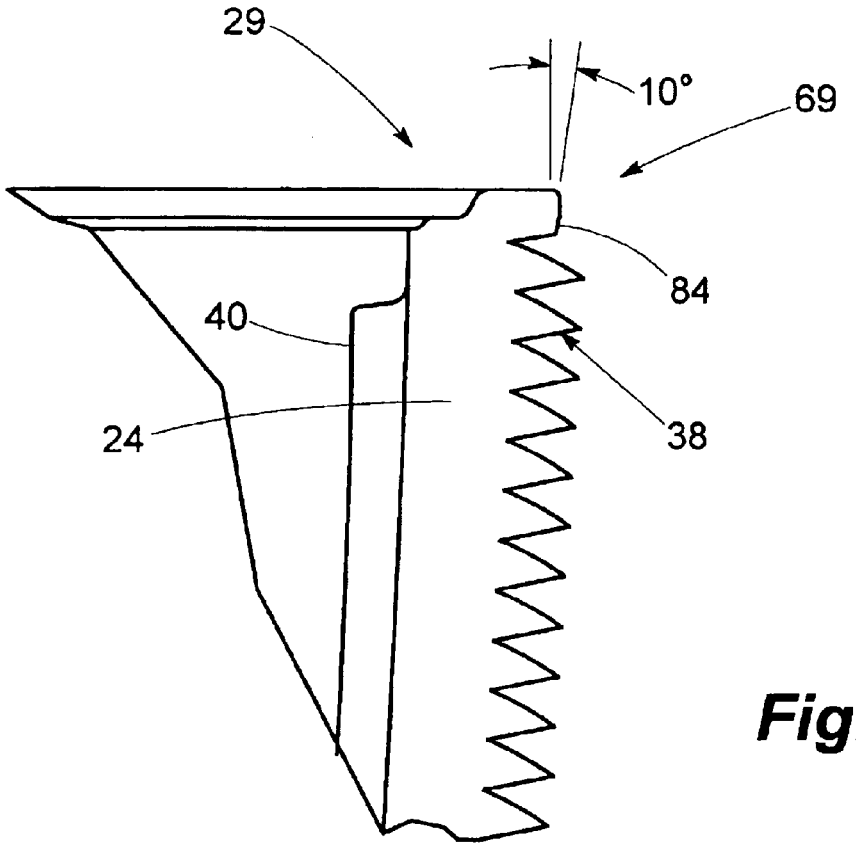
FIG. 11 is a schematic illustrating shaped surfaces of a seam configured according to the invention and being contoured to direct light rays above horizontal for glare reduction; and, FIG. 12 is a schematic illustrating diagrammatically the relationship of lamp placement to seam contours necessary to direct light externally of a luminaire globe for glare reduction.

Referring now to the drawings and particularly to FIGS. 1 and 10, at least a portion of a prior art luminaire is seen at 10 to comprise a globe 11 formed of a reflector portion 12 and a refractor portion 14, the portions 12 and 14 being attached together at a seam therebetween by means of a band 16 which is typically formed of metal. A hanger bar 18 is typically employed to suspend the luminaire 10 in a conventional manner. The reflector portion 11 and a refractor portion 14 are typically formed of a borosilicate glass or acrylic plastic as well as a variety of other light-transmissive materials such as are commonly employed in the art. The band 16 typically is formed of a sheet metal material that is mechanically rolled and used to fasten the portions 12, 14 together about protruding flanges (not shown in FIG. 1), the structure of the flanges being better appreciated by reference to FIG. 11 wherein a prior art refractor 70 similar in structure and function to the refractor portion 14 of FIG. 1 is seen to be provided with a flange 72 protruding from outer surfaces of the refractor 70. It is to be appreciated that the flange 72 is essentially annular in conformation and extends peripherally about the refractor 70. The luminaire 10 of FIG. 1 as well as the refractor 70 and flange 72 of FIG. 11 are conventional in the art.

A joint thus formed between the prior art reflector portion 12 and the refractor portion 14 is typically formed by smooth-surfaced flange elements (not shown in FIG. 1), a silicon adhesive (not shown) also typically being employed between said flange elements to improve attachment between the portions 12 and 14. Flange elements of the portions 12, 14, such as the flange 72 of the prior art refractor 70 of FIG. 10, protrude from exterior surfaces of said portions 12, 14 due in part to the necessity for rolling the metal band 16 over at least major portions of exterior surfaces of said flange elements such as the flange 72 of FIG. 10 in order to provide an appropriate connection between the portions 12, 14. As is common in the art, prisms and/or other light-directing structure can be formed on interior and/or exterior surfaces of the reflector portion 12 and the refractor portion 14.

The seam or joint between the reflector portion 12 and the refractor portion 14 of the prior art luminaire globe 11 must be reconfigured when it is desired to create a luminaire globe of an appearance wherein a smooth, uninterrupted and bandless profile is desired. Further, the optical characteristics of a luminaire globe should be improved in an acceptable commercial luminaire when a bandless profile is desired. At least a portion of the light generated by a light source (not shown) located within the luminaire globe 11 is wasted through incidence on interior surfaces of the band 16 since a banded seam between the portions 12 and 14 will not pass light in the manner of the light-transmissive portions of the reflector portion 12 and the refractor portion 14. However, even if the band 16 were to be removed, prior art connection expedients utilized to attach the reflector portion 12 to the refractor portion 14 can be less than satisfactory. Optical glint or glare typically occurs as a ring of brightness on passage of light through a seam as is provided by a flange structure such as is embodied in the prior art flange 72 of FIG. 10. In order to reduce an undesirable high degree of brightness at a seam between reflector and refractor portions of a luminaire globe, the embodiments of the present invention are provided.

Figure 5A:
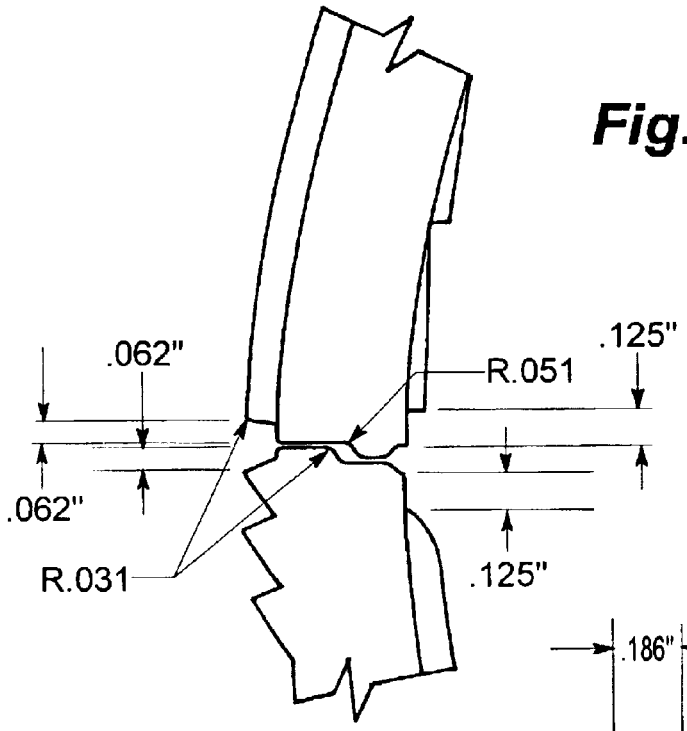
FIGS. 5A and 5B are schematics of the contoured surfaces of the peripheral edges of the reflector and refractor sections and being dimensioned.
Figure 5B:
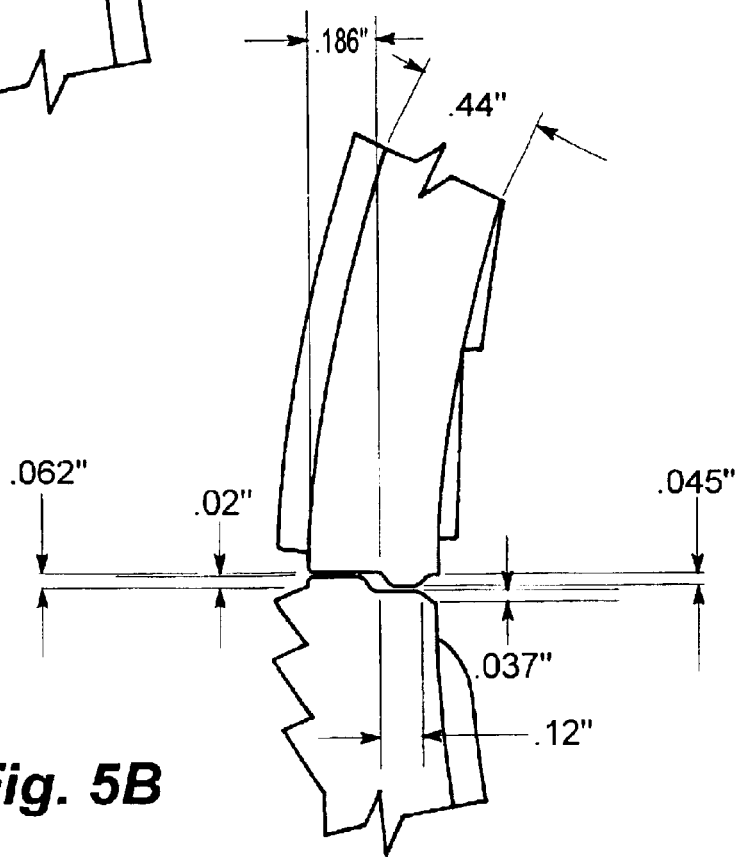
Figure 6:
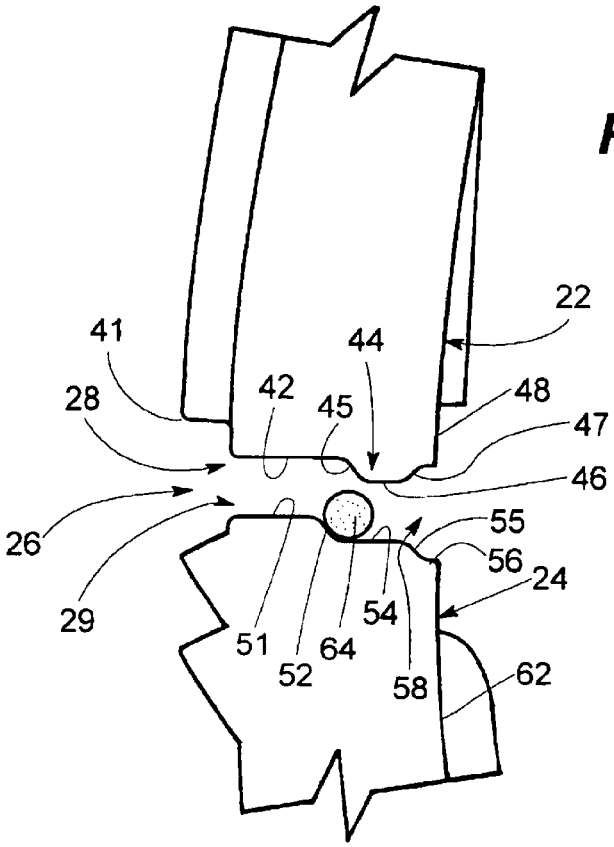
FIG. 6 is a schematic of edge portions of the reflector and refractor portions of a luminaire globe configured according to the invention and illustrating placement of an adhesive bead therebetween.
Figure 7:
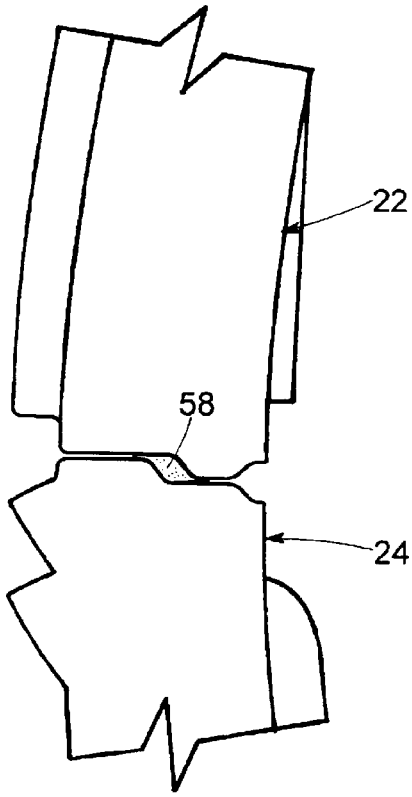
FIG. 7 is a schematic illustrating the mated disposition of the peripheral edge portions of the reflector and refractor portions of a luminaire globe configured according to the invention and illustrating disposition of the curved adhesive of FIG. 6 between said edges.
Figure 8:
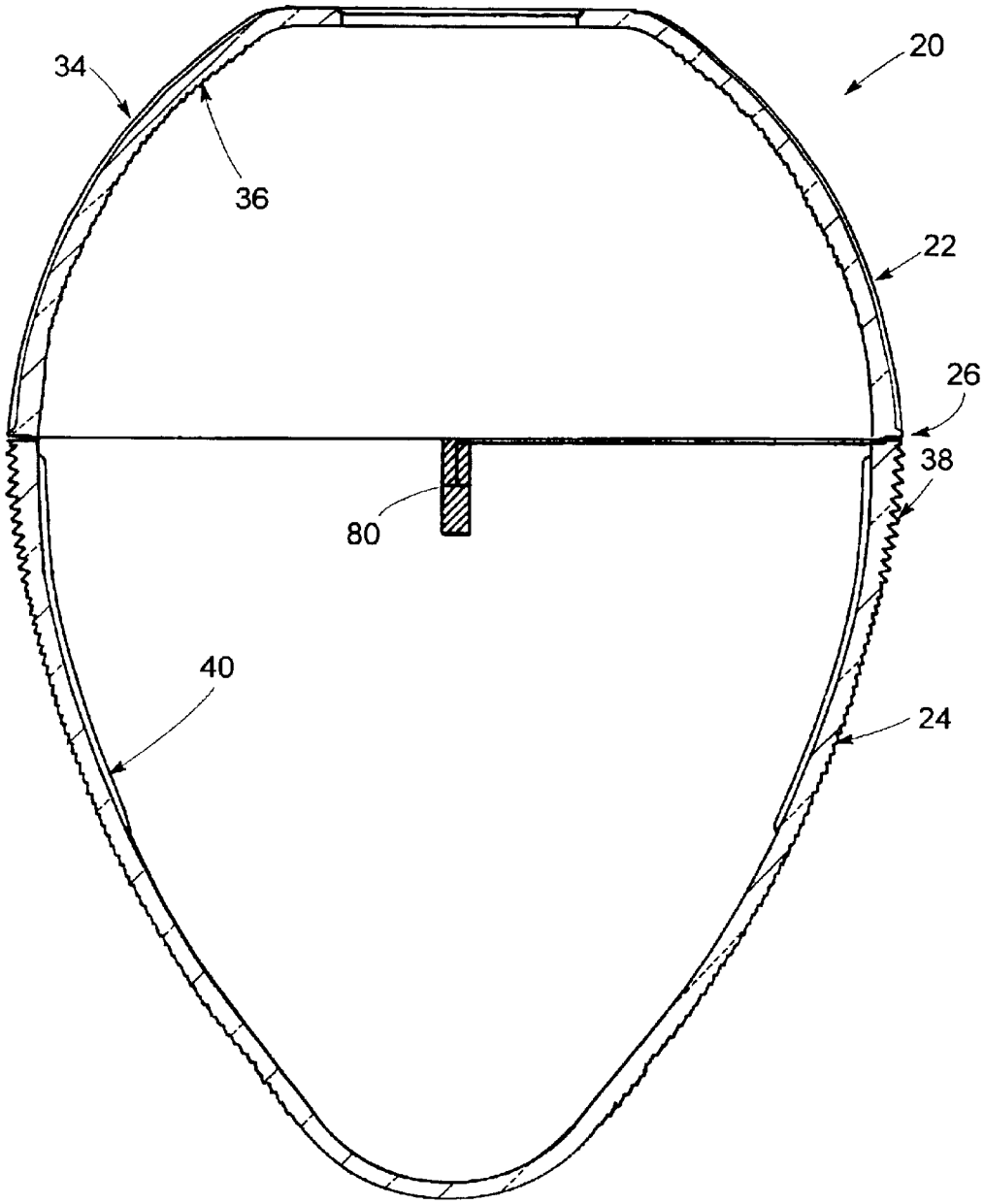
FIG. 8 is a side elevation in section of a luminaire globe configured according to a further embodiment of the invention and illustrating attachment of reflector and refractor portions together with only the use of adhesive.

Referring now to FIG. 8, a luminaire globe is seen at 20 to be formed of a reflector section 22 and a refractor section 24, the sections 22 and 24 having a seam or joint seen at 26 formed therebetween at the loci of attachment between respective annular peripheral edges 28, 29 of said sections 22, 24. The annular peripheral edge 28 of the reflector section 22 is also seen with reference to FIGS. 3 through 7 to take the form of a surface of revolution having a cross-sectional shape as is seen in FIGS. 5A, 5B and 6 inter alia. Similarly, the annular peripheral edge 29 of the refractor portion 14 can be seen to take the form of a surface of revolution having a cross-sectional shape as is best seen in FIGS. 5 and 6 inter alia. The edges 28 and 29 are engaged to form the seam 26 and are preferably connected together at least in part by an adhesive material such as will be described hereinafter. As can also be seen with reference to FIG. 9, mechanical expedients can also be employed for connecting a refractor section to a reflector section in the event that the refractor section is of a weight requiring an additional fastening function between reflector and refractor portions of a luminaire globe as will be described hereinafter. As can also be appreciated, the reflector section can alternatively be formed of a material such as aluminum.

Figure 2:
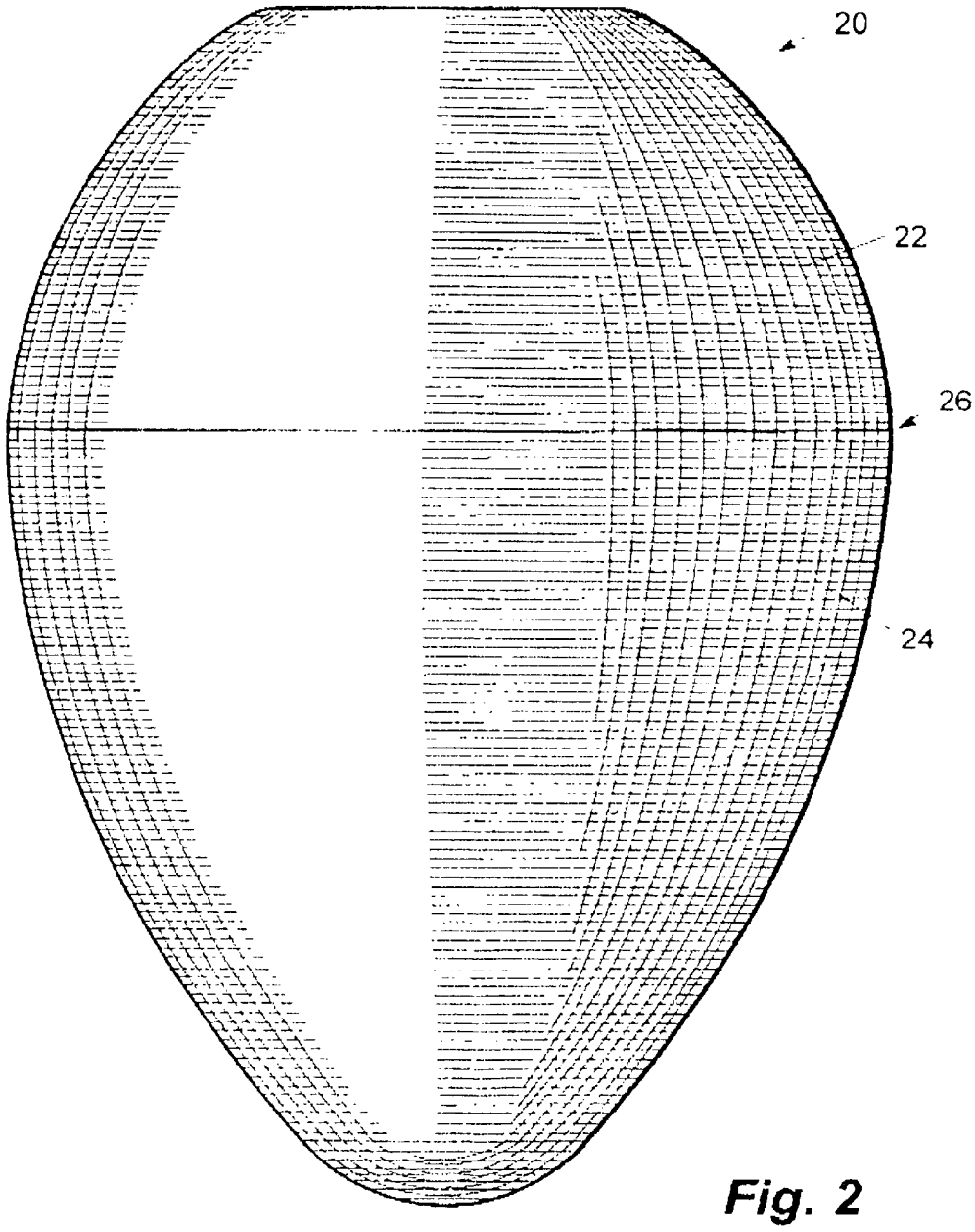
FIG. 2 is a side elevational view of a luminaire globe configured according to the invention and illustrating a bandless seam as can be provided through a practice of the invention.
Figure 3:
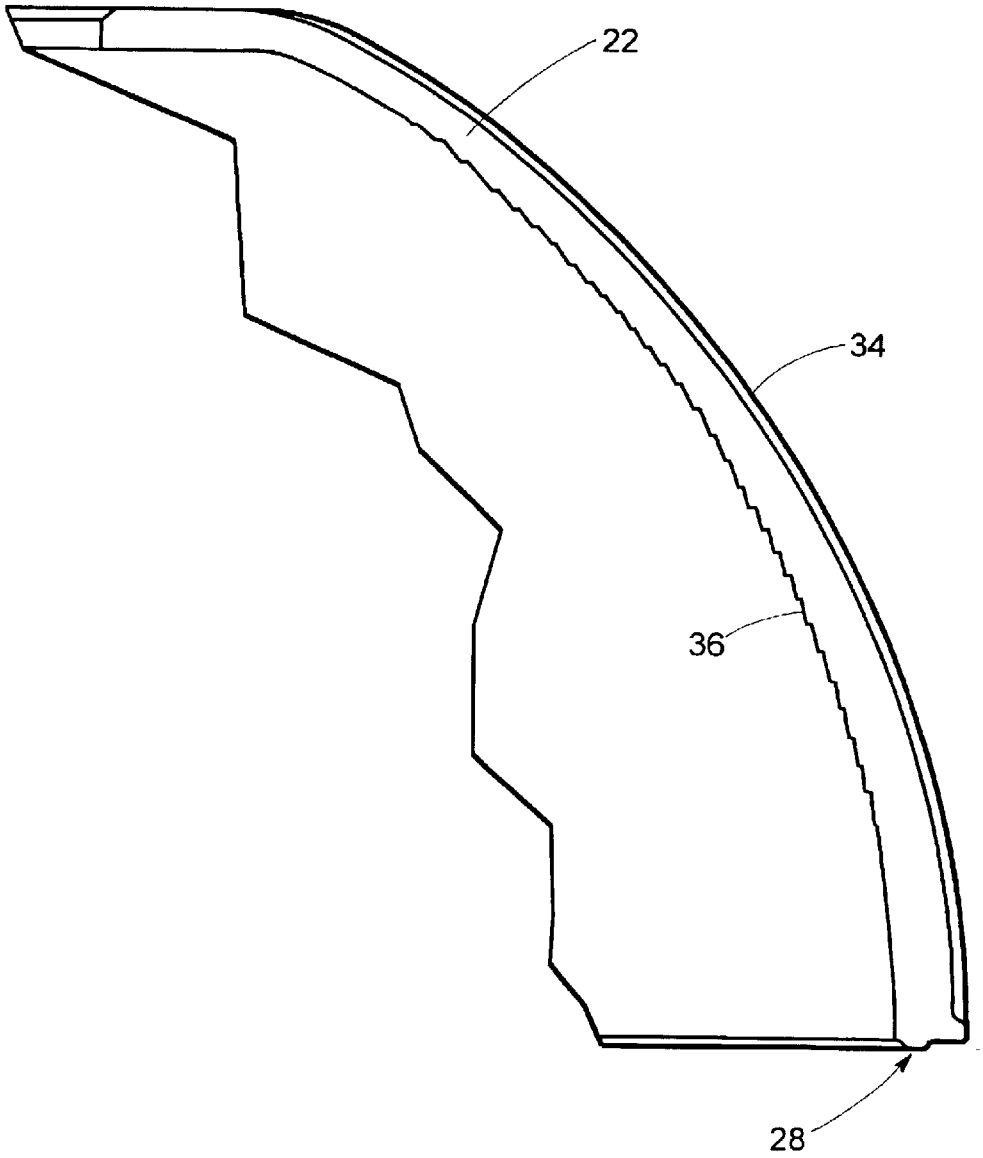
FIG. 3 is a detailed side elevational view in section of a reflector portion of a luminaire globe configured according to the invention and illustrating details of contours of an annual peripheral edge thereof.
Figure 4:
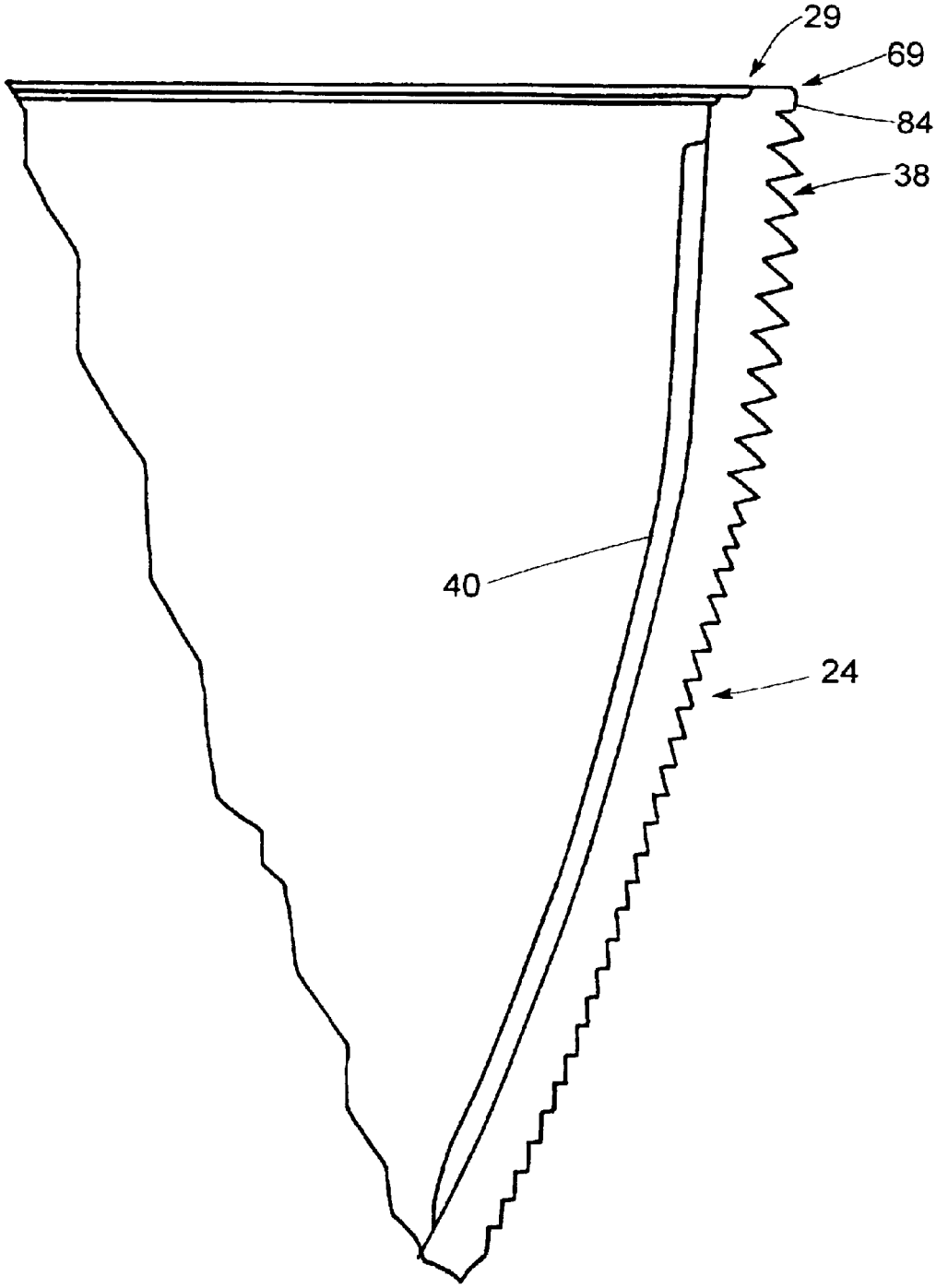
FIG. 4 is a detailed side elevational view in section of a refractor portion of a luminaire globe configured according to the invention and illustrating the shaped contours of a peripheral edge of the refractor portion, said edges being mateable to corresponding edges of the reflector portion seen in FIG. 3.

It is to be seen in FIG. 8 inter alia that the reflector section 22 can be formed with external prisms 34 and internal prisms 36 as is conventional in the art although the prisms 34, 36 can be formed as is described in the copending U.S. patent applications referred to hereinabove. Similarly, the refractor section 24 can be provided with external prisms 38 and internal prisms 40 that can either be conventional in the art or formed as is described in the copending United States patent applications referred to hereinabove. In FIG. 2, a particular configuration of a luminaire globe according to the invention is shown to be formed of a reflector section and a refractor section such as the sections 22 and 24 respectively, the globe having only certain prisms exaggerated at portions of the refractor section 24 relative to other external prisms formed thereon merely for ease of illustration.

Referring particularly to FIGS. 3 through 7, the peripheral edge 28 of the reflector section 22 is seen as being preferably formed in a particular shape that is rounded at corner 41 at an outer surface of the reflector section 22, the corner 41 rounding to a flat surface at 42 which curves inwardly of a medial portion of said edge 28 to form a boss 44 having a curved outward shoulder 45 and a curved inward shoulder 47, a flat surface 46 defining the boss 44 between the shoulders 45 and 47. The curved shoulder 47 terminates through intersection with interior surface 48 of the reflector section 22.

The peripheral edge 29 of the refractor section 24 has a rounded corner at 50 disposed at the outside surface of the refractor section 24, the rounded corner 50 curving to a flat surface at 51 which then rounds at 52 to form a curved shoulder which then terminates in a curved shoulder 52 slightly outwardly of a medial portion of the edge 29. The shoulder 52 rounds to form a flat surface 54 which in turn curves inwardly of the refractor section 24 to form a curved shoulder 55 which then rounds to form a shoulder 56 which terminates through intersection with an interior surface 62 of the refractor section 24.

The preferred shapes of the edges 28 and 29 as thus described are seen to extend fully about said sections 22, 24. The refractor section 24 is joined to the reflector section 22 by means of a bead 64 of adhesive as is best seen in FIG. 6, the bead of adhesive being placed preferably in juxtaposition to the curved shoulder 52 and above outer portions of the flat surface 54. Pressing of the edges 28 and 29 together causes the adhesive bead 64 to deform and flow between said edges 28, 29 with excess adhesive being forced toward the interior of the seam 26 and expressed inwardly thereof and into that space formed at 58 between the shoulder 47 of the edge 28 and the shoulder 56 of the edge 29. Since interior surfaces of the luminaire globe 20 cannot be viewed from externally thereof, it is not necessary to clean up excess adhesive expressed into the space 58. Since adhesive is directed inwardly of the globe 20, a clean appearance is created externally of the seam 26 as the luminaire globe 20 viewed from externally thereof. The geometry of the shaped surfaces of the edges 28, 29 causes adhesive to flow relatively evenly thereover so that maximum adhering function is obtained. Further, the geometry of the edges 28, 29 permits a predetermined distance to remain between major portions of the opposing edges 28, 29 so that adhesive is located essentially in a channel between the edges 28, 29 and cures therebetween. Particularly favorable dimensions of the shaped surfaces of the edges 28, 29 can be seen in FIGS. 5A and 5B. It is to be understood that the surfaces 42 and 51 are preferably parallel and that the surfaces 46 and 54 are parallel.

The adhesive material employed according to preferred embodiments of the invention comprises a silicone adhesive sealant such as that material manufactured by the General Electric Company under the trade designation RTV108. This adhesive material, as well as other similar materials manufactured by General Electric and others, is a one-component adhesive that cures at room temperature to essentially form a silicone rubber. The bead 64 of adhesive material when composed of the RTV108 adhesive is preferably caused to have a nominal diameter of approximately 0.12 inch. It is to be understood that suitable adhesive materials can be otherwise selected for use according to the invention. The bead 64 can be applied by conventional means such as a caulking gun or an automatic dispenser.

FIG. 7 illustrates the reflector section 22 and the refractor section 24 in a position whereby said sections 22, 24 are joined together by means of the adhesive thus described and wherein the edges 28, 29 abut to the degree permitted by the shape thereof, adhesive being disposed therebetween in a cured state as is represented in FIG. 7.

Figure 9:
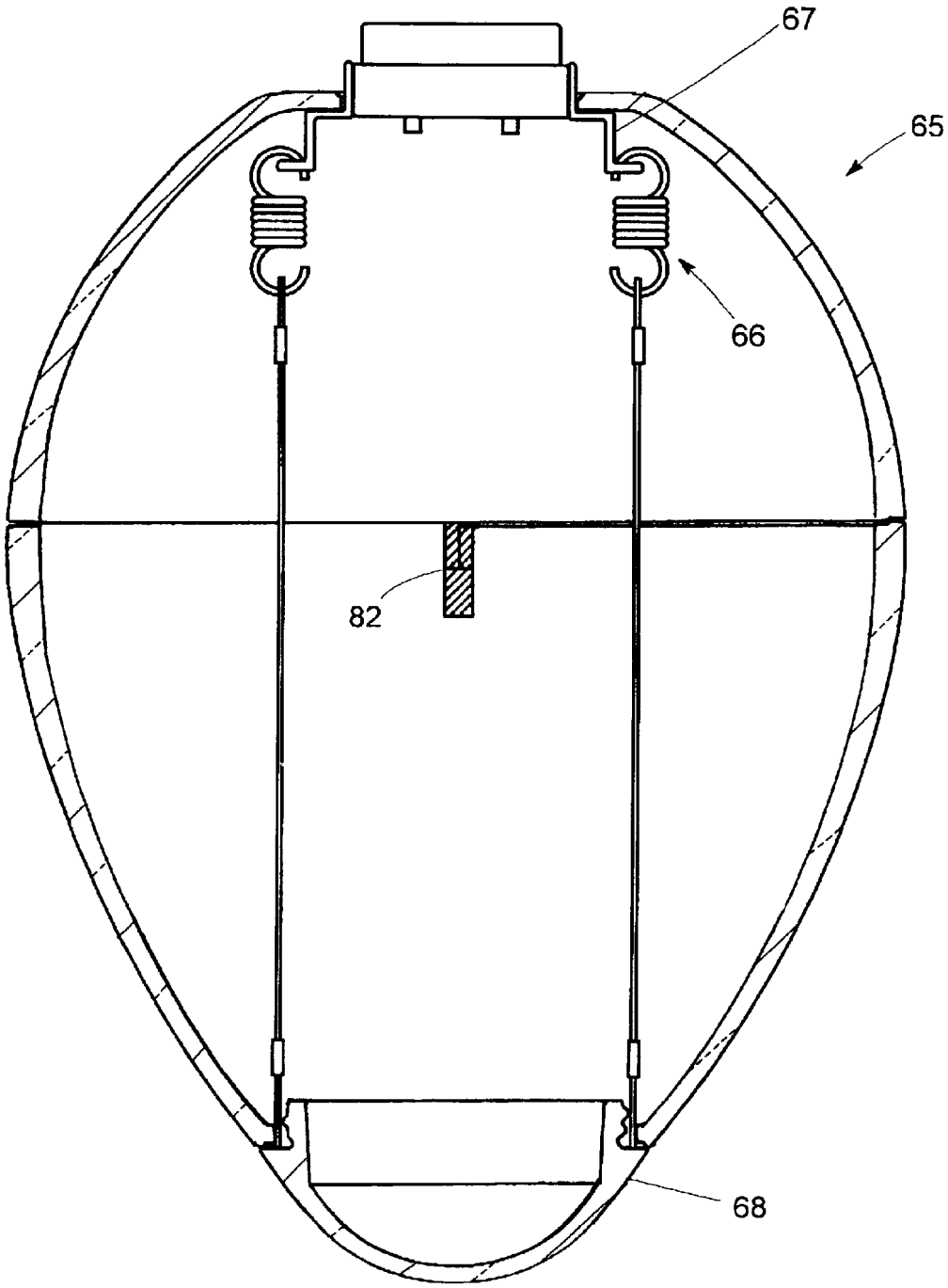
FIG. 9 is a side elevation in section of a luminaire globe configured according to one embodiment of the invention and utilizing mechanical expedients to additionally effect attachment of reflector and refractor portions together.

Referring now to FIG. 9, a luminaire globe seen at 65 is seen to be provided with mechanical supporting structure at 66, said structure 66 connecting between a mounting collar 67 and a door 68. Mechanical mechanisms of varying description can be employed to assist in the mounting of reflector and refractor portions of the luminaire globe 65 together in the event that a refractor portion of the globe 65 is of a size and weight requiring an increased degree of connective function to exist between reflector and refractor portions. In the luminaire globe 20 of FIG. 8, the size of said globe 20 is chosen so that the refractor section 24 can be joined to the reflector section 22 solely by means of adhesive material as described above even though said sections 22, 24, and particularly the refractor section 24 are formed of glass or similar material. The ability to adequately join the refractor section 24 to the reflector section 22 is occasioned by the shaping of the edges 28, 29 as described above such that adhesive material is caused to evenly flow within a joint formed between said edges 28, 29 at the seam 26 and be held between said edges 28, 29 with a desired spacing therebetween to permit appropriate curing of the adhesive material. As is seen in FIGS. 8 and 9, luminaire globes 20, 65 configured according to the invention have a smooth, interrupted bandless profile providing an appearance desirable in the art.

Figure 12:
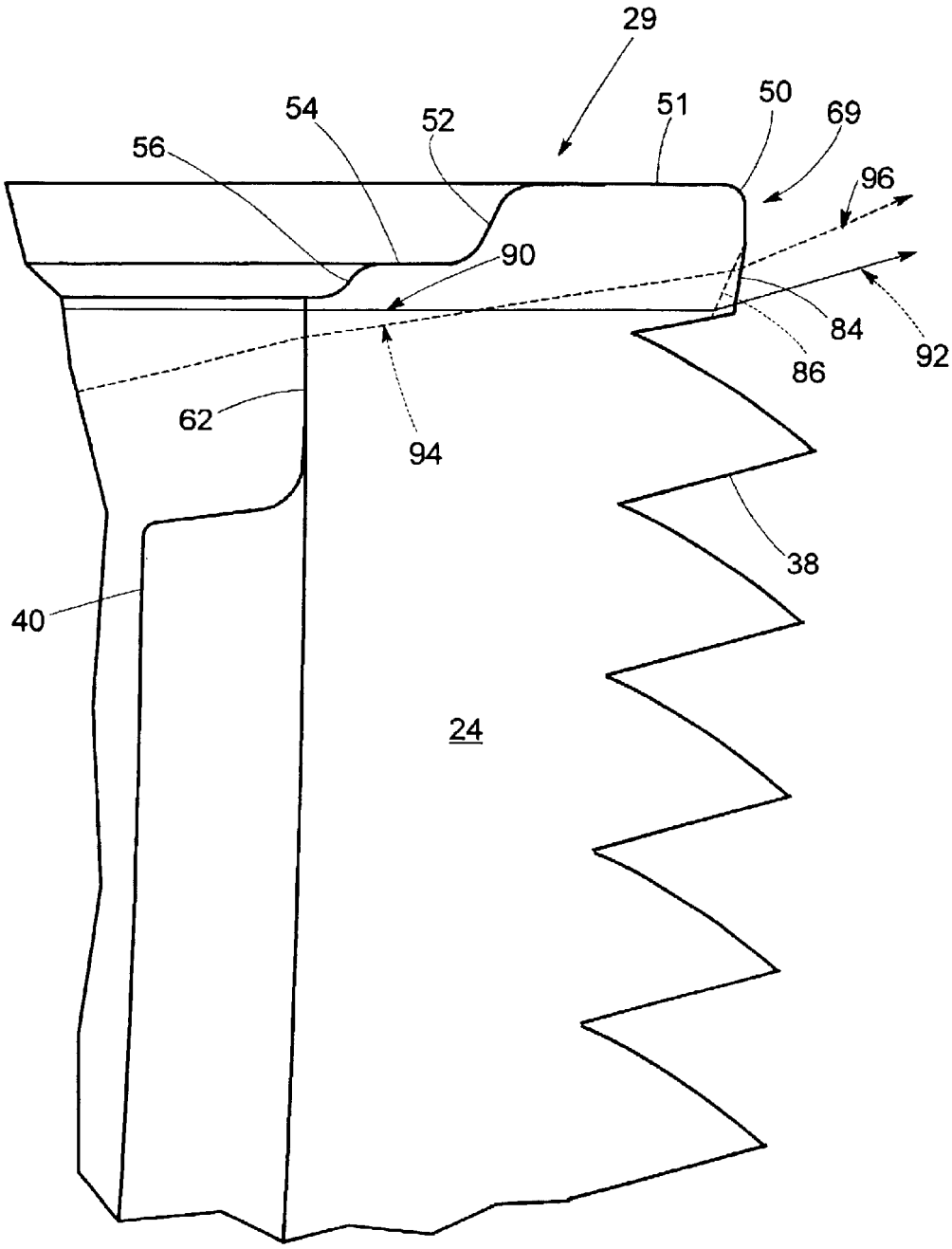

Referring now to FIGS. 11 and 12, it is to be seen that the seam 26 of the luminaire globe 20, as exemplary and as is designated as 26 in FIG. 2 inter alia, can be formed with reduced brightness at said seam 26 such that a bright circle is not produced at the seam 26 as is characteristic of prior art luminaire globes formed of reflector and refractor portions configured of light-transmissive material in particular. Optical glint or glare is therefore reduced or eliminated according to the invention as will be now detailed.

Referring again now to FIG. 10, the prior art flange 72 is seen to protrude outwardly of exterior surfaces of the prior art refractor 70 and to be of a conventional thickness. In particular, the prior art flange 72 of FIG. 10, as is typical of conventional flanges, is of a thickness of approximately 0.312 inch measured as is seen in FIG. 10. In contradistinction, the edge 29 of the refractor section 24 as seen in FIG. 11 inter alia is seen to include an annulus 69 that is 0.139 inch thick. Prisms, such as the prisms 38 referred to hereinabove are located immediately beneath the annulus 69 of the refractor section 24. At least certain of the prisms 38 are formed immediately below said annulus 69 in contradistinction to the location of the prisms 74 of FIG. 10 which are spaced from lower surfaces of the prior art flange 72. Further, the annulus 69 of FIG. 11 is seen to be provided with a flat lower shoulder 84 which is angled at a degree of approximately 10° to an essentially vertical line tangent to or coincident with outermost annular surfaces 86 of said annulus 69. It is to be understood that the flat lower shoulder 84 is not seen in certain other drawing figures herein due to drawing size limitations, the shoulder 84 being present in structure represented by such drawing figures though not seen. A light ray 76 as seen in FIG. 10 to pass through the prior art flange 72 of the prior art refractor 70 remains horizontal on passage through said prior art flange 72 and thus produces glare. In contradistinction, a light ray 78 as seen in FIG. 11 on passing through the annulus 69 is seen to be directed upwardly above horizontal as is seen at 79 to thereby reduce glare. Further, the reduced thickness of the annulus 69 relative to the flange 72 acts to reduce the amount of light passing through said annulus at the seam 26 of the luminaire globe 20. Light passing through that portion of the refractor walls of the prior art refractor 70 between lower surfaces of the prior art refractor 70 and the first prism 74 disposed therebelow is also seen as glare or as an addition to a band of brightness additive to the horizontal light rays passing through the prior art flange 72, thereby producing glare. The prisms 38 disposed immediately below the annulus 69 as seen in FIG. 11, and particularly where prisms 38 are configured as are described in copending U.S. patent application Ser. No. 10/280,279, filed of even date, and entitled "Prismatic Structures Having Shaped Surfaces" and assigned to a common assignee, particularly act to redirect light such that the light passing therethrough is directed in a useable direction and does not produce glare or an optical glint through the seam 26.

FIG. 10 particularly illustrates the manner of preventing glare in an environment wherein the top of a lamp arc tube, such as is represented at 80 in FIG. 8 and at 82 in FIG. 9, is essentially disposed substantially level or even with the seam 26, that is, at the top of the joint formed between the edges 28, 29 of the reflector section 22 and the refractor section 24 respectively. When a lamp arc tube, such as the tubes represented at 80 and 82 as aforesaid, is moved from the level position referred to above, it becomes necessary to alter the angle of the shoulder 84 in the event that the lamp arc tube is moved higher within the interior of a luminaire globe such as the luminaire globe 20 or the luminaire globe 65. In the event that a lamp were to be moved lower within such globes, the 10° angle of the shoulder 84 accommodates light ray 90 as seen in FIG. 12 and causes said light ray to be directed upwardly as at 92. However, movement of a lamp arc tube to a higher location within the luminaire globe 20, for example, would require an increase in the angle of the face of the shoulder 84 to an angle represented by the dashed line 86 in order to cause light ray 94 to refract upwardly above horizontal to prevent glare. As an example, a 1.5 inch change in the effective light center of a lamp source would require a 25° rather than a 10° angle in order to direct light upwardly as at 96.

It is to be understood that the invention can be practiced other than as is explicitly described herein, the globe 20 of the invention being useful in a pole-mounted application as well as for suspended applications. The invention intends and achieves a seam having a virtually non-visible appearance from externally thereof whether or not illuminated. The shaped edges 28 and 29 of the reflector and refractor sections 22, 24 should be understood to be preferred as shown due to the ability of said edges 28, 29 in concert to control radial distribution of adhesive throughout the periphery of the seam 26 to assure coverage by the adhesive over mating surfaces of the edges 28, 29. The shaped edges 28, 29 further act to center the sections 22, 24 relative to each other on mounting of said sections 22, 24 together in addition to preventing overflow of adhesive outside the seam 26 and directing any excess adhesive inwardly of said seam 26. The scope of the invention, however, is to be defined by the appended claims.

What is claimed is:

1. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof; and, means carried by the reflector section for suspending the globe, the refractor section being joined to the reflector section only by the adhesive material.

2. In the luminaire globe of claim 1 and further comprising means formed on each of the opposing peripheral edge surfaces and cooperating to express excess portions or the adhesive material inwardly of the luminaire globe to the interior of the globe.

3. In the luminaire globe of claim 2 and further comprising means formed on each of the peripheral edge surfaces to define a space into which excess portions of the adhesive material are expressed.

4. In the luminaire globe of claim 1 wherein the reflector section and the refractor section are formed of glass.

5. In the luminaire globe of claim 1 and further comprising a flange formed on free edges of each of the reflector section and the refractor section, the respective opposing peripheral edge surfaces being formed respectively on each one of the flanges, the flanges having a thickness reduced relative to the thickness of conventional flanges of reflector and refractor sections.

6. In the luminaire globe of claim 5 wherein the flange of the refractor section has a peripheral outer wall, a lower edge of the outer wall being angled relative to upper surfaces of said outer wall to direct light through the flange of the refractor section above horizontal to reduce glare.

7. In the luminaire globe of claim 6 wherein an effective center of the light source is disposed within the globe at a position level with the refractor flange.

8. In the luminaire globe of claim 7 wherein the angle is approximately 10°.

9. In the luminaire globe of claim 6 wherein the angle increases as the effective center of the light source is lowered within the globe relative to the refractor flange.

10. In the luminaire globe of claim 5 wherein the flanges are formed integrally with the respective reflector and refractor sections.

11. In the luminaire globe of claim 1 and further comprising means formed on at least the refractor section in the vicinity of the same for directing light passing through the refractor section in proximity to the seam in a direction above horizontal to reduce glare.

12. In the luminaire globe of claim 1 and further comprising:

a flange formed on a free edge of the refractor section, the peripheral edge surface of the refractor section being formed on the flange; and, prismatic means formed on external surfaces of the refractor section immediately below the flange for directing light incident thereon downwardly of the refractor section to produce useful illumination.

13. In the luminaire globe of claim 1 and further comprising mechanical means connecting the reflector section to the refractor section internally of the luminaire globe.

14. In the luminaire globe of claim 1 wherein the adhesive material comprises a silicone rubber adhesive.

15. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means fanned on each of the opposing peripheral edge surfaces and cooperating to cause the adhesive material to flow evenly over at least major portions of the edge surfaces on mating of the reflector section to the refractor section through engagement between the edge surfaces thereof; and, means formed on each of the opposing peripheral edge surfaces and cooperating to express excess portions of the adhesive material inwardly of the luminaire globe to the interior of the globe.

16. In the luminaire globe of claim 15 and further comprising means carried by the reflector section for suspending the globe, the refractor section being joined to the reflector section only by the adhesive material.

17. In the luminaire globe of claim 15 and further comprising means formed on each of the peripheral edge surfaces to define a space into which excess portions of the adhesive material are expressed.

18. In the luminaire globe of claim 15 wherein the reflector section and the refractor section are formed of glass.

19. In the luminaire globe of claim 15 and further comprising a flange formed on free edges of each of the reflector section and the refractor section, the respective opposing peripheral edge surfaces being formed respectively on each one of the flanges, the flanges having a thickness reduced relative to the thickness of conventional flanges of reflector and refractor sections.

20. In the luminaire globe of claim 19 wherein the flange of the refractor section has a peripheral outer wall, a lower edge of the outer wall being angled relative to upper surfaces of said outer wall to direct light through the flange of the refractor section above horizontal to reduce glare.

21. In the luminaire globe of claim 20 wherein an effective center of the light source is disposed within the globe at a position level with the refractor flange.

22. In the luminaire globe of claim 21 wherein the angle is approximately 10°.

23. In the luminaire globe of claim 20 wherein the angle increases as the effective center of the light source is lowered within the globe relative to the refractor flange.

24. In the luminaire globe of claim 19 wherein the flanges are formed integrally with the respective reflector and refractor sections.

25. In the luminaire globe of claim 15 and further comprising means formed on at least the refractor section in the vicinity of the same for directing light passing through the refractor section in proximity to the seam in a direction above horizontal to reduce glare.

26. In the luminaire globe of claim 15 and further comprising:

a flange formed on a free edge of the refractor section, the peripheral edge surface of the refractor section being formed on the flange; and, prismatic means formed on external surfaces of the refractor section immediately below the flange for directing light incident thereon downwardly of the refractor section to produce useful illumination.

27. In the luminaire globe of claim 15 and further comprising mechanical means connecting the ref lector section to the refractor section internally of the luminaire globe.

28. In the luminaire globe of claim 15 wherein the adhesive material comprises a silicone rubber adhesive.

29. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof; and, means formed on each of the peripheral edge surfaces to define a space into which excess portions of the adhesive material are expressed.

30. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof; and, a flange formed on free edges of each of the reflector section and the refractor section, the respective opposing peripheral edge surfaces being formed respectively on each one of the flanges, the flanges having a thickness reduced relative to the thickness of conventional flanges of reflector and refractor sections.

31. In the luminaire globe of claim 30 wherein the flange of the refractor section has a peripheral outer wall, a lower edge of the outer wall being angled relative to upper surfaces of said outer wall to direct light through the flange of the refractor section above horizontal to reduce glare.

32. In the luminaire globe of claim 31 wherein an effective center of the light source is disposed within the globe at a position level with the refractor flange.

33. In the luminaire globe of claim 32 wherein the angle is approximately 10°.

34. In the luminaire globe of claim 31 wherein the angle increases as the effective center of the light source is lowered within the globe relative to the refractor flange.

35. In the luminaire globe of claim 30 wherein the flanges are formed integrally with the respective reflector and refractor sections.

36. In the luminaire globe of claim 30 and further comprising means formed on at least the refractor section in the vicinity of the same for directing light passing through the refractor section in proximity to the seam in a direction above horizontal to reduce glare.

37. In the luminaire globe of claim 30 and further comprising:

a flange formed on a free edge of the refractor section, the peripheral edge surface or the refractor section being formed on the flange; and, prismatic means formed on external surfaces of the refractor section immediately below the flange for directing light incident thereon downwardly of the refractor section to produce useful illumination.

38. In the luminaire globe of claim 30 and further comprising mechanical means connecting the reflector section to the refractor section internally of the luminaire globe.

39. In the luminaire globe of claim 30 wherein the adhesive material comprises a silicone rubber adhesive.

40. In the luminaire globe of claim 30 and further comprising means formed on each of the opposing peripheral edge surfaces and cooperating to express excess portions of the adhesive material inwardly of the luminaire globe to the interior of the globe.

41. In the luminaire globe of claim 40 and further comprising means formed on each of the peripheral edge surfaces to define a space into which excess portions of the adhesive material are expressed.

42. In the luminaire globe of claim 30 wherein the reflector section and the refractor section are formed of glass.

43. In the luminaire globe of claim 30 and further comprising means carried by the reflector section for suspending the globe, the refractor section being joined to the reflector section only by the adhesive material.

44. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof; and, means formed on at least the refractor section in the vicinity of the same for directing light passing through the refractor section in proximity to the seam in a direction above horizontal to reduce glare.

45. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means fanned on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof;

a flange formed on a free edge of the refractor section, the peripheral edge surface of the refractor section being formed on the flange; and, prismatic means formed on external surfaces of the refractor section immediately below the flange for directing light incident thereon downwardly of the refractor section to produce useful illumination.

46. In a luminaire globe having a reflector section joined to a refractor section at a seam formed by respective opposing peripheral edge surfaces, said sections being at least partially formed of a light-transmissive material, a light source being mounted within the globe, said edge surfaces defining the seam having an adhesive material disposed therebetween for adhering the reflector section and the refractor section together, the improvement comprising:

means formed on each of the opposing peripheral edge surfaces and cooperating to space at least portions of said edge surfaces apart, at least major portions of the adhesive material being disposed between said edge surfaces;

means formed on each of the opposing peripheral edge surfaces and cooperating to cause the adhesive material to flow evenly over at least major portions of the edge surfaces on mating of the reflector section to the refractor section through engagement between the edge surfaces thereof; and, mechanical means connecting the reflector section to the refractor section internally of the luminaire globe.

* * * * *